US005850759A

United States Patent [19]

Kim

[11] Patent Number: 5,850,759

[45] Date of Patent: Dec. 22, 1998

[54] FORCE FEED BACK MANIPULATOR WITH SIX DEGREES OF FREEDOM

[75] Inventor: Jeong-Tae Kim, Kyunggi-Do, Rep. of Korea

[73] Assignee: Daewoo Electronics Co., Ltd., Seoul, Rep. of Korea

[21] Appl. No.: 773,868

[22] Filed: Dec. 27, 1996

[30] Foreign Application Priority Data

Dec. 29, 1995 [KR] Rep. of Korea ..... 1995-66362

[51] Int. Cl.[6] ..... G05G 9/00

[52] U.S. Cl. ..... 74/471 X; 901/16; 901/25; 901/34

[58] Field of Search ..... 74/471 XY, 469, 74/471 R, 479.01; 901/16, 23, 25, 34

[56] References Cited

U.S. PATENT DOCUMENTS

| | | | |
|---|---|---|---|
| 3,561,280 | 2/1971 | MacPhee et al. | 74/471 XY |
| 4,216,467 | 8/1980 | Colston . | |
| 4,281,561 | 8/1981 | Groskopfs | 74/471 XY |
| 4,641,123 | 2/1987 | Whitehead | 74/471 XY |
| 4,982,618 | 1/1991 | Culver | 74/471 XY |
| 5,223,776 | 6/1993 | Radke et al. | 74/471 XY |
| 5,235,868 | 8/1993 | Culver | 74/471 XY |
| 5,263,382 | 11/1993 | Brooks et al. | 74/471 XY |
| 5,271,290 | 12/1993 | Fischer | 74/471 XY |
| 5,473,235 | 12/1995 | Lance et al. | 74/471 XY |

FOREIGN PATENT DOCUMENTS 2261052 5/1993 United Kingdom .

*Primary Examiner*—Rodney H. Bonck
*Assistant Examiner*—David M. Fenstermacher
*Attorney, Agent, or Firm*—Anderson, Kill & Olick, P.C.

[57] ABSTRACT

A manipulator with six degrees of freedom includes a moving plate having three points arranged with substantial equal angles therebetween, a fixed plate having three protruding portions arranged with substantial equal angles therebetween, the fixed plate being positioned under the moving plate and being spaced apart from the moving plate, and three frames rotatably mounted on the protruding portions, respectively, each of the three frames having a first and a second points opposite from each other about the protruding portion. In order to connect one of the three points on the moving plate to the first and the second points on one of the three frames, respectively, thereby enabling the moving plate to move relatively to the fixed plate with six degrees of freedom and to detect distance variations between the one point on the moving plate and the first point, and between the one point on the moving plate and the second point, when the moving plate moves, the manipulator includes three universal joints, six rack gears, six pinion gears and six shaft encoders.

4 Claims, 6 Drawing Sheets

FORCE FEED BACK MANIPULATOR WITH SIX DEGREES OF FREEDOM

FIELD OF THE INVENTION

The present invention is directed to a force feed back manipulator having six degrees of freedom; and, more particularly, to a force feed back manipulator having a reduced size and being capable of determining six parameters required to control a position and an orientation of an object in a three dimensional space.

DESCRIPTION OF THE PRIOR ART

Referring to FIG. 1, there is shown a prior art parallel manipulator 10 employing hydraulic cylinders. The manipulator 10 has a triangular fixed plate 18 and a triangular moving plate 12 positioned above the fixed plate 18 with a separation therebetween. Six hydraulic cylinders 16*a*, 16*b*, 16*c*, 16*d*, 16*e* and 16*f* connect the moving plate 12 to the fixed plate 18. Through the cylinders 16*a*, 16*c*, 16*d*, 16*e* and 16*f*, the moving plate 12 is able to move with six degrees of freedom with respect to the fixed plate 18, wherein the six degrees of freedom refers three translational movements along X, Y and Z axis in rectangular coordinates and three rotational movements about the three axis.

If an operator changes the position and/or orientation of the moving plate 12 by using a control stick(not shown) on the moving plate 12, the six hydraulic cylinders 16*a*, 16*b*, 16*c*, 16*d*, 16*e* and 16*f* experience variations in their length, respectively. The six length variations of the hydraulic cylinders 16*a*, 16*b*, 16*c*, 16*d*, 16*e* and 16*f* which indicate how the moving plate 12 was moved with respect to the fixed plate 18 are measured by a detection device(not shown). The measured values are data which a simulator or movement reproducing system requires in understanding and reproducing the position or the orientation changes of the moving plate 12.

The manipulator structured in this manner, however, is too large in size to be used with a small sized simulator or the like because it employs hydraulic cylinders.

Another prior art manipulator 20 for overcoming the shortcoming in the hydraulic cylinder type manipulator 10 is shown in FIG. 2. The manipulator 20 includes a moving plate 24 having a control stick 22 and a fixed plate 28. The moving plate 24 is connected to the fixed plate 28 through three link assemblies 34*a*, 34*b* and 34*c* which connect three frames 28*a*, 28*b* and 28*c* on the fixed plate 28 to three universal joints(only 32*a* and 32*b* are shown).

One link assembly 34*a* includes four links and is hinged to the universal joint 32*a* and the frame 28*a*. Mounted on the frame 28*a* are a sun gear 30*a* rotatable about a crossing of the links, and two planetary gears 38*a* and 38*b* engaged with the sun gear 30*a*. The planetary gears 38*a* and 38*b* are connected to shafts of DC motors 40, respectively. Each of the DC motors 40 has a shaft encoder 42 which detects a rotation of the planetary gear. When the moving plate 24 moves freely, the links move in response to the movement of the moving plate 24, rotating the planetary gears 38*a* and 38*b* around the sun gear 30*a*. The rotation of the planetary gears 38*a* and 38*b* are detected by the shaft encoders 42 and sent to an electronic control unit(not shown).

As well known in the art, however, only six detected values by the shaft encoders 42 of the planetary gears 38*a* and 38*b* cannot indicate completely the movements of the moving plate 24. Therefore, the shaft of the frame 28*a* must be provided with another shaft encoder 42 which detects a rotation thereof. Thus, the manipulator 20 has nine shaft encoders 42.

While the manipulator employing links described above is capable of performing its assigned task, it is provided with numerous shaft encoders, necessitating a need to reduce the number of shaft encoders incorporated therein.

SUMMARY OF THE INVENTION

It is, therefore, a primary object of the invention to provide a force feed back manipulator having a reduced size and being capable of indicate a position or an orientation of an object in a three dimensional space with six parameters.

The above and other objects of the invention are accomplished by providing a manipulator having six degrees of freedom comprising: a moving plate having three points arranged with substantial equal angles therebetween; a fixed plate having three protruding portions arranged with substantial equal angles therebetween, the fixed plate being positioned under the moving plate and being spaced apart from the moving plate; three frames rotatably mounted on the protruding portions, respectively, each of said three frames having a first and a second points opposite from each other about the protruding portion; and three connection and detection means each of which connects one of the three points on the moving plate to the first and the second points on one of the three frames, respectively, thereby enabling the moving plate to move relative to the fixed plate with six degrees of freedom and each of which detects distance variations between said one point on the moving plate and the first point, and between said one point on the moving plate and the second point, when the moving plate moves.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
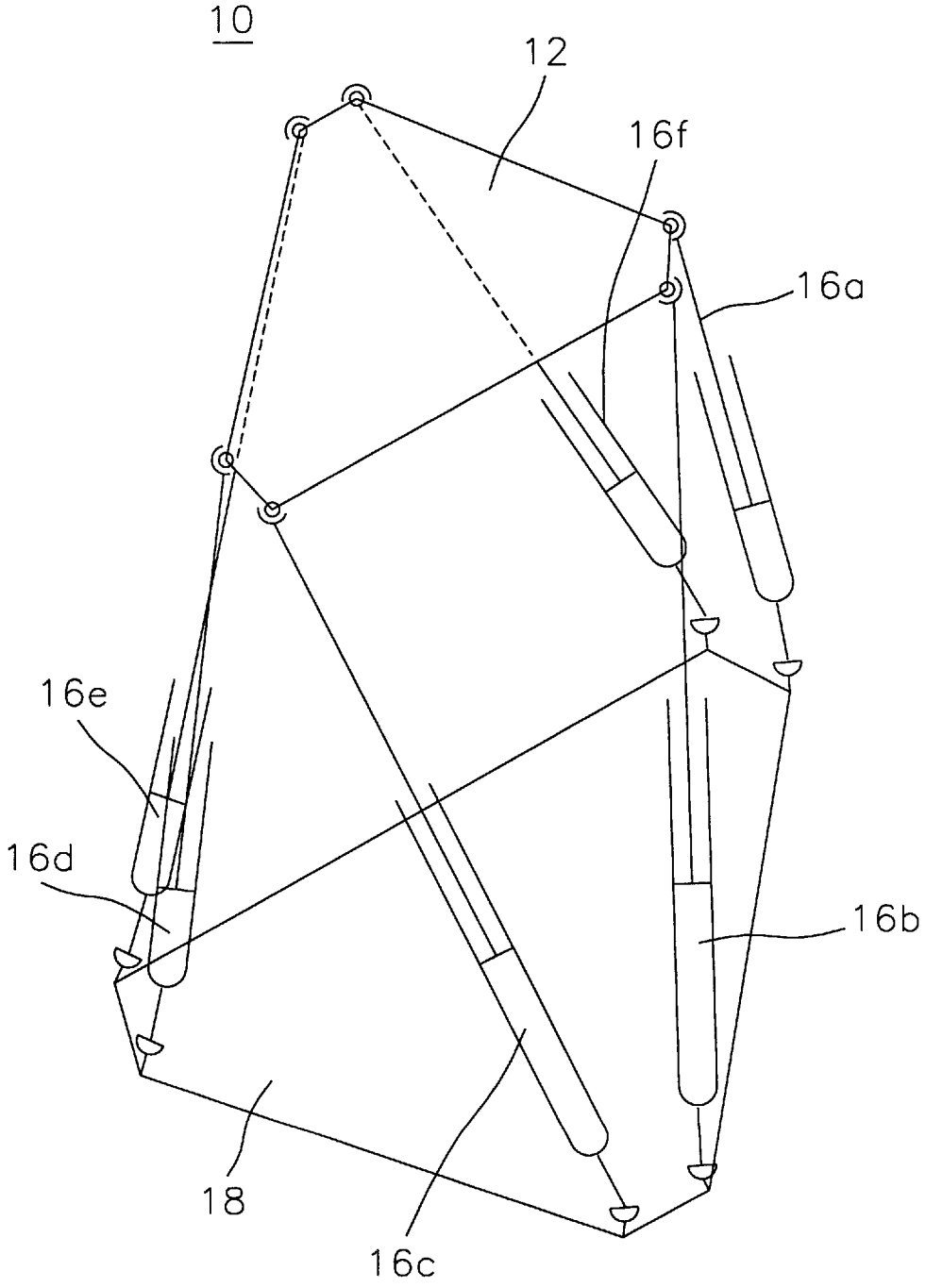
FIG. 1 (PRIOR ART)
FIG. 1 shows a schematic view of a prior art parallel manipulator employing hydraulic cylinders.
Figure 2:
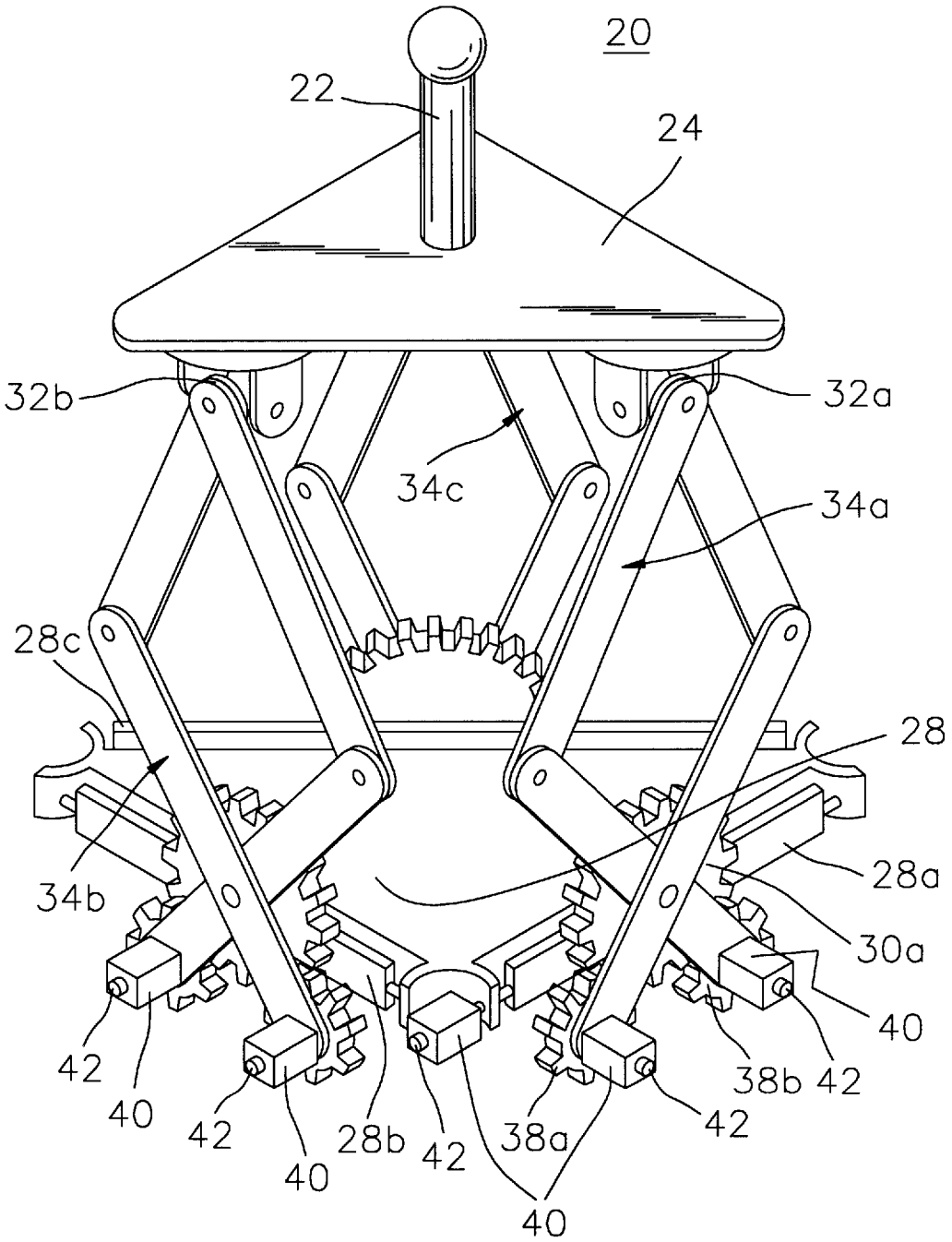
FIG. 2 (PRIOR ART)
FIG. 2 represent a perspective view of a prior art parallel manipulator employing links.
Figure 3:
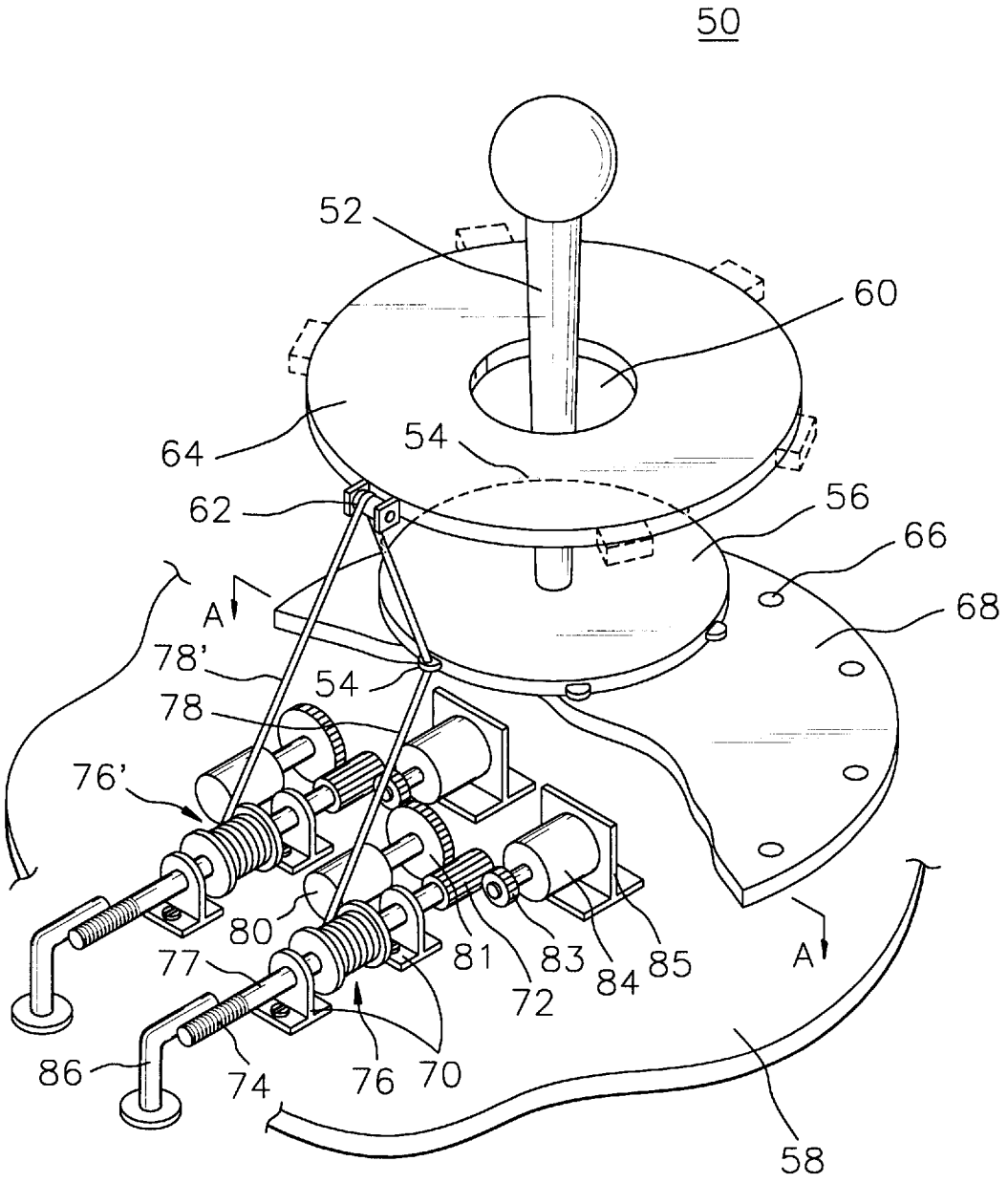
FIG. 3 illustrates a perspective view of a force feed back manipulator having six degrees of freedom in accordance with the present invention.

FIG. 3 shows a perspective view of a force feed back manipulator 50 in accordance with the present invention. The inventive manipulator 50 has an upper moving plate 54 of a substantial triangular shape and a lower fixed plate 58 of a substantially circled shape positioned under the upper moving plate 54, being spaced apart from the same the upper moving plate 54. The moving plate 54 has three universal joints 64 on its three corners, respectively. The moving plate 54 further has a handling stick 52 vertically extending from an upper surface thereof.

The fixed plate 58 has a circle portion 59 and three protruding plates 61 laterally extending from the circle portion, being angularly equally arranged therebetween at 120°. Three frames 62 are pivotably mounted on the protruding plates 61, respectively. Each of the frames 62 is arranged along a tangent line of the circle portion 59 at the corresponding protruding plate 61 and is pivotable about the tangent line. The fixed plate 58 is fixed on a base plate 56 through a supporting bar 56*a*.

The moving plate 54 and the fixed plate 58 are connected with each other through three connecting units 60. In the inventive manipulator 50, in order to determine position or orientation changes of the moving plate 54, distance variations between each of the corners on the moving plate 54 and two fixed points nearby each corner, e.g., two points on the frame 62, are measured by the connecting units 60. Each of the connecting units 60 connects one universal joint 64 on the moving plate 54 to both ends of one frame 62 on the fixed plate 58. Detailed description about one connecting unit 60 is made with reference to FIGS. 4 and 5, hereinafter.

Figure 5A:
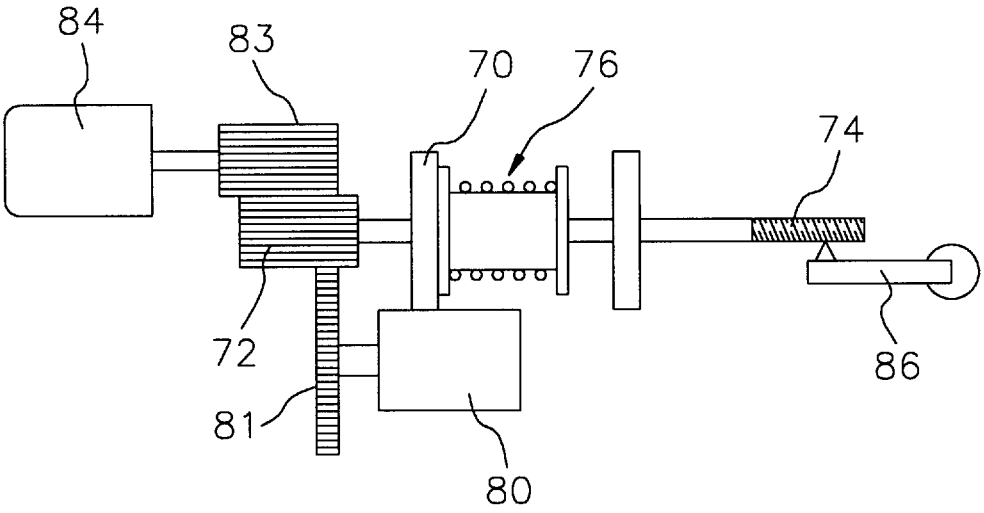
FIG. 5 presents a schematic view of a connecting unit of the inventive manipulator.
Figure 5B:
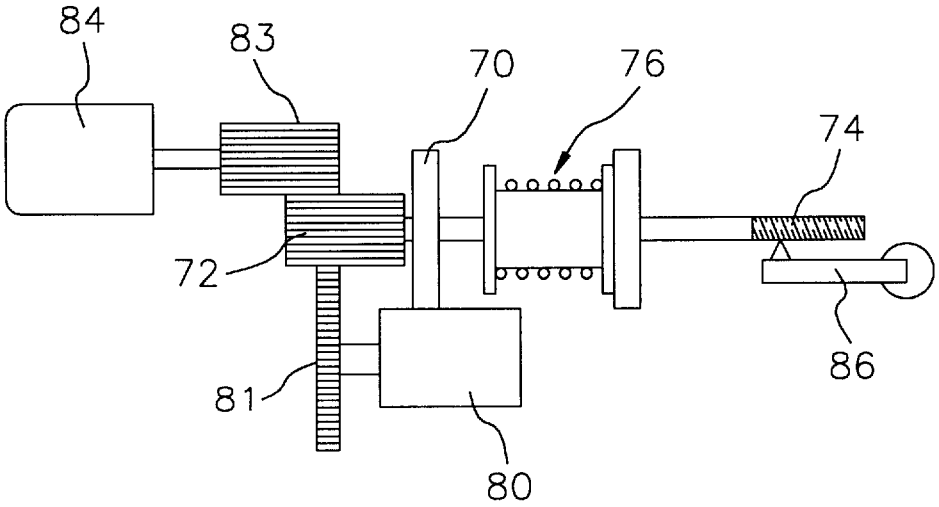

As shown in FIG. 5, the connecting unit 60 includes two rack gears 68 hinged to the universal joint 64, and two gear assemblies 75 connected to the pair of rack gears 68, respectively. Each of the rack gears 68 is rotatable about three axes 64*a*, 64*b* and 64*c* with respect to the moving plate 54. The pair of gear assemblies 75 are mounted on both ends of the frame 62, respectively. The frame 62 is supported on the protruding plate 61 through the use of a pin 63 to thereby be pivotable about the pin 63. Each of the gear assemblies 75 includes a pinion gear 76 having an internal gear 74 and an external gear 70, a pair of intermediate gears 72, a center gear 73 and an encoder gear 79.

Figure 4:
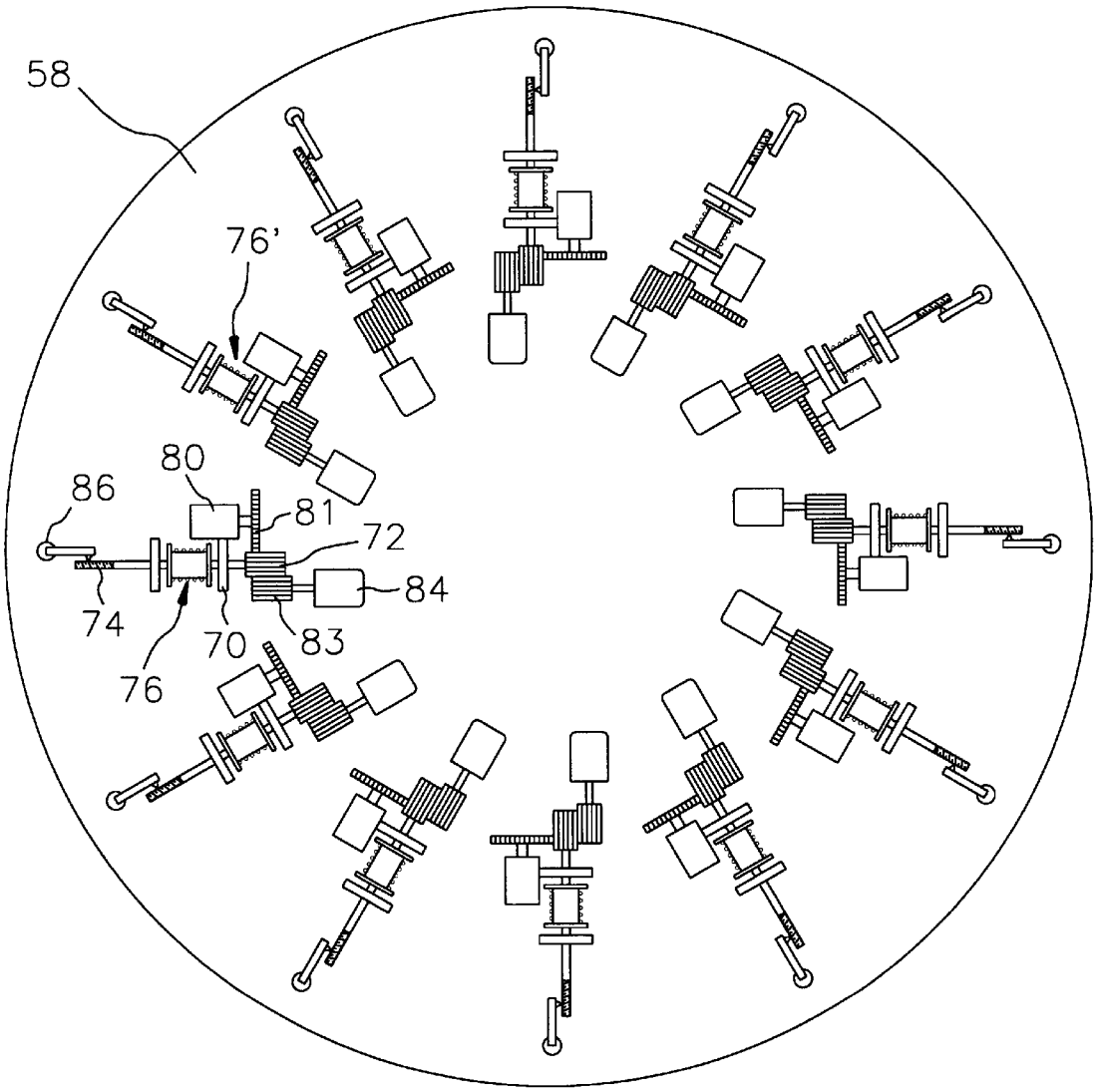
FIG. 4 depicts a sectional view of the inventive manipulator, when taken along a line A–A'.

As shown in FIGS. 4 and 5, the pinion gear 76 is engaged with the rack gear 68 at its external gear 70 and both intermediate gears 72 at its internal gear 74. The intermediate gears 72 are symmetrically arranged with respect to each other about the center gear 73 which is connected to a shaft 81 of a driving motor 80. The driving motor 80 drives the center gear 73 to resist the movement of the moving plate 54 depending on a signal from an electronic control unit (ECU). The encoder gear 79 engaged with the pinion gear 76 is connected to an encoder 78 which detects the rotation of the pinion gear 76 and is connected to the ECU.

Figure 6:
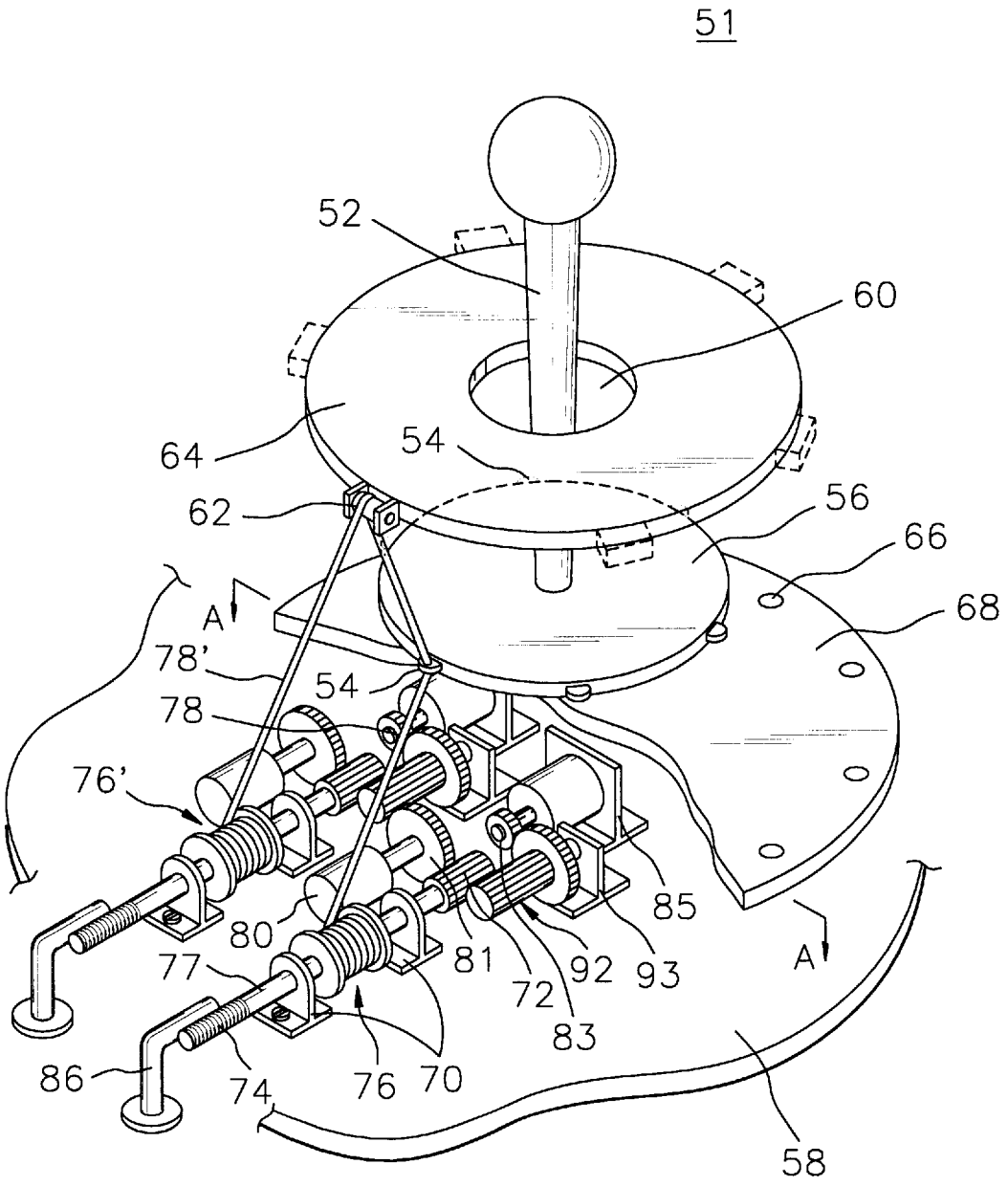
FIG. 6 is a block diagram showing a force feed back conception of the inventive manipulator.

Operations of the inventive manipulator is described referring to FIGS. 3 and 6.

When an operator manipulates the handling stick 52 and moves the moving plate 54, e.g., upward, downward, laterally, and back and forth, or rotationally, the rack gears 68 of the three connecting units 60 move in response to the movement of the moving plate 54 and rotate the pinion gears 76, respectively. The rotation of the pinion gear 76 is detected by the encoder 78 through the encoder gear 79 engaged with the pinion gear 76. The detected values by the six encoders 78 are sent to the ECU. Values processed by the ECU may be used as an input information for a simulating system, a computer game or a movement reproducing device.

On the other hand, in accordance with the present invention, when every movement of the moving plate 54 is made, a reverse load which hinders the movement of the moving plate 54 may be applied by the driving motor 80. This "force feed back" is obtained in such a manner that when the moving plate 54 moves, information on the moving plate movement is first sent to the ECU from the encoders 78, the ECU performs a predetermined operations to determine values for the force feed back and sends the values to the driving motors 80, respectively. The force feed back function may be needed in virtual reality systems.

Although the invention has been shown and described with respect to the preferred embodiments, it will be apparent to those skilled in the art that various changes and modifications may be made without departing from the spirit and scope of the invention as defined in the following claims.

What is claimed is:

1. A manipulator having six degrees of freedom comprising:

a moving plate having three moving points arranged with substantial equal angles therebetween;

a fixed plate having three protruding portions arranged with substantial equal angles therebetween, the fixed plate being positioned under the moving plate and being spaced apart from the moving plate;

three frames rotatably mounted on the protruding portions, respectively, each frame having a first fixed point and a second fixed point located opposite said first fixed point; and three universal joints mounted beneath the moving plate, corresponding to the three moving points, respectively;

three rack gear sets, each rack gear set having a pair of rack gears hinged to one of said three universal joints;

three pinion gear sets, each pinion gear set being associated with one of said three frames to provide an associated frame and one of said three rack gear sets to provide an associated rack gear set, each pinion gear set includes a first pinion gear positioned on said first fixed point of said associated frame and being engaged with one of said pair of rack gears of said associated rack gear set, and a second pinion gear positioned on said second fixed point of said associated frame and being engaged with another of said pair of rack gears of said associated rack gear set; and three shaft encoder sets, each shaft encoder set includes:

a first shaft encoder having a first encoder gear engaged with said first pinion gear of one of said pinion gear sets to provide an associated pinion gear set, said first shaft encoder detects a distance variation between one moving point and said first fixed point of said associated frame in accordance with a rotation of said first pinion gear of said associated pinion gear set when the moving plate moves, and a second shaft encoder having a second encoder gear engaged with said second pinion gear of said associated pinion gear set, said second shaft encoder detects a distance variation between said one moving point and said second fixed point of said associated frame in accordance with a rotation of said second pinion gear of said associated pinion gear set when the moving plate moves.

2. The manipulator of claim 1, wherein the moving plate includes a handling stick vertically extending therefrom.

3. The manipulator of claim 1, further comprising three driving motor sets, each driving motor set includes a first driving motor for rotating said first pinion gear of said associated pinion gear set via a first power transmitting means, and a second driving motor for rotating the second pinion gear of said associated pinion gear set via a second power transmitting means.

4. The manipulator of claim 3, wherein said first power transmitting means includes:

a first internal gear formed with the first pinion gear of said associated pinion gear set;

a pair of first intermediate gears engaged with said first internal gear; and a first center gear connected to the first driving motor and positioned between said pair of first intermediate gears, said first center gear being engaged with said pair of first intermediate gears; and wherein said second power transmitting means includes:

a second internal gear formed with the second pinion gear of said associated pinion gear set;

a pair of second intermediate gears engaged with said second internal gear; and a second center gear connected to the second driving motor and positioned between said pair of second intermediate gears, said second center gear being engaged with said pair of second intermediate gears.

* * * * *

UNITED STATES PATENT AND TRADEMARK OFFICE

CERTIFICATE OF CORRECTION

PATENT NO. : 5,850,759

DATED : December 22, 1998

INVENTOR(S) : Jeong-Tae Kim

It is certified that error appears in the above-identified patent and that said Letters Patent is hereby corrected as shown below:

On title page item [30], should read as follows:

[30] Foreign Application Priority Data

Dec. 29, 1995 [KR] Rep. of Korea 95-66362

Signed and Sealed this

Thirtieth Day of March, 1999

*Attest:*

*Attesting Officer*

Q. TODD DICKINSON

*Acting Commissioner of Patents and Trademarks*